US009696642B2

(12) United States Patent
Adachi et al.

(10) Patent No.: US 9,696,642 B2
(45) Date of Patent: Jul. 4, 2017

(54) ELECTROPHOTOGRAPHIC PHOTORECEPTOR AND ELECTROPHOTOGRAPHIC IMAGING APPARATUS EMPLOYING THE SAME

(71) Applicant: SAMSUNG ELECTRONICS CO., LTD., Suwon-si, Gyeonggi-do (KR)

(72) Inventors: Mami Adachi, Yokohama (JP); Manabu Takezawa, Yokohama (JP); Hiroshi Miyao, Yokohama (JP)

(73) Assignee: S-PRINTING SOLUTION CO., LTD., Suwon-Si (KR)

( * ) Notice: Subject to any disclaimer, the term of this patent is extended or adjusted under 35 U.S.C. 154(b) by 0 days.

(21) Appl. No.: 15/245,611

(22) Filed: Aug. 24, 2016

(65) Prior Publication Data

US 2017/0160655 A1 Jun. 8, 2017

(30) Foreign Application Priority Data

Dec. 8, 2015 (JP) ..... 2015-239273
Feb. 17, 2016 (KR) ..... 10-2016-0018532

(51) Int. Cl.
*G03G 5/147* (2006.01)

(52) U.S. Cl.
CPC ..... *G03G 5/14791* (2013.01)

(58) Field of Classification Search
CPC ..... G03G 5/14713; G03G 5/14717; G03G 5/14734; G03G 5/14786
See application file for complete search history.

(56) References Cited

U.S. PATENT DOCUMENTS 5,374,494 A 12/1994 Kashimura et al.
2011/0045391 A1* 2/2011 Maeda ..... G03G 5/14704 430/56
2011/0127528 A1 6/2011 Matsumuro

FOREIGN PATENT DOCUMENTS

| | | |
|---|---|---|
| JP | 63-073267 | 4/1988 |
| JP | 06-027708 | 2/1994 |
| JP | 11-095473 | 4/1999 |
| JP | 11-095474 | 4/1999 |
| JP | 3262488 | 12/2001 |
| JP | 2005-107490 | 4/2005 |
| JP | 2006-038919 | 2/2006 |
| JP | 2008-261971 | 10/2008 |
| JP | 2010-34343 | 2/2010 |

(Continued)

*Primary Examiner* — Peter Vajda
(74) *Attorney, Agent, or Firm* — Staas & Halsey LLP

(57) ABSTRACT

An electrophotographic photoreceptor having excellent cleaning performance and high durability for a long time and an electrophotographic imaging apparatus employing the electrophotographic photoreceptor are provided. The electrophotographic photoreceptor includes a photosensitive layer and a protective layer sequentially formed in this stated order on a conductive support. The protective layer includes a metal oxide surface-treated with a phosphorous-containing compound, wherein the metal oxide includes at least one selected from a group consisting of tin oxide, zinc oxide, and titanium oxide. The phosphorous-containing compound is a polymer including a phosphorus-oxoacid moiety reacting with the metal oxide, a photo-reactive moiety, and a lubricative moiety including at least one selected from a group consisting of fluorine and silicon at side chains.

20 Claims, 5 Drawing Sheets

(56) References Cited

FOREIGN PATENT DOCUMENTS

| | | |
|---|---|---|
| JP | 2011-170129 | 9/2011 |
| JP | 2015-132639 | 7/2016 |

* cited by examiner

ELECTROPHOTOGRAPHIC PHOTORECEPTOR AND ELECTROPHOTOGRAPHIC IMAGING APPARATUS EMPLOYING THE SAME

CROSS-REFERENCE TO RELATED APPLICATIONS

This application claims the priority benefits of Japanese Patent Application No. 2015-239273, filed on Dec. 8, 2015, in the Japanese Patent Office and Korean Patent Application No. 10-2016-0018532, filed on Feb. 17, 2016, in the Korean Intellectual Property Office, the disclosures of which are incorporated herein in their entireties by reference.

BACKGROUND

1. Field

The present disclosure relates to electrophotographic photoreceptors and electrophotographic imaging apparatuses.

2. Description of the Related Art

Recently, organic photoreceptors using organic materials have come into widespread use as electrophotographic photoreceptors due to lower manufacturing costs thereof than inorganic photoreceptors such as amorphous silicon.

Various electric and mechanical stresses caused by charging, toner attaching, transferring, and cleaning processes are applied to a surface layer of an organic photoreceptor. Since these stresses applied to the surface layer of the organic photoreceptor may degrade image quality, there is a need to develop a photoreceptor having high durability.

In order to remove toner or paper dust attached to the surface of the organic photoreceptor and hydrophilic materials generated during a charging process, cleaning methods by bringing a urethane-based rubber cleaning blade into contact with the surface of the photoreceptor have been generally used.

However, when the surface of the photoreceptor has high frictional resistance, the cleaning blade may be inverted or a squeal noise may be generated from the cleaning blade. In addition, as the cleaning blade is slowly damaged, and toner leaks from the cleaning blade, image defects may be caused due to poor cleaning performance. Thus, by improving cleaning performance by inhibiting frictional resistance of the surface of the photoreceptor, images may be stably acquired for a long time.

Meanwhile, in view of abrasion resistance, mechanical properties of a photoreceptor may be improved by forming a protective layer on the surface of the photoreceptor and introducing a curable resin or a filler into the protective layer. For example, a protective layer including a curable resin and formed on the surface of the photoreceptor, a protective layer including a filler, and an attempt made to further improve the mechanical strength of a protective layer by surface-treating a filler and allowing the surface-treated filler to form a cross-linking structure with adjacent resin have been disclosed.

However, sufficient cleaning performance cannot be obtained merely by increasing mechanical strength. It is difficult to obtain a photoreceptor having all of abrasion resistance, cleaning performance, and scratch resistance. Thus, attempts have been made to reduce frictional resistance of the surface of the photoreceptor by improving lubricity of the surface of the photoreceptor by adding fluorine resin particles to a protective layer.

Protective layers to which fluorine resin particles are added have been disclosed. However, even when using such protective layers, it is difficult to maintain a high cleaning performance of the protective layers for a long time.

In addition, an attempt has been made to add a lubricant such as silicone oil to a protective layer and a protective layer to which silicone oil is added has been disclosed. However, the lubricant often forms segregation on the surface of the photoreceptor, and thereby, effects thereof may vanish as the surface of the photoreceptor wears away.

A protective layer to which silicone oil having a functional group is added in order to inhibit surface segregation of the lubricant has been disclosed. However, it is difficult to inhibit surface segregation even when the silicone oil having a structure illustrated in this patent document is used, and thus, such a silicone oil is insufficient to maintain a high cleaning performance for a long time.

SUMMARY

Provided are electrophotographic photoreceptors having excellent cleaning performance and high durability for a long time and electrophotographic imaging apparatuses employing the electrophotographic photoreceptors.

Additional aspects will be set forth in part in the description which follows and, in part, will be apparent from the description, or may be learned by practice of the presented embodiments.

An embodiment of an electrophotographic photoreceptor according to an aspect of the present disclosure includes: a conductive support; a photosensitive layer disposed on the conductive support; and a protective layer disposed on the photosensitive layer, wherein the protective layer includes: a photocurable resin matrix; and metal oxide particles surface-treated with a phosphorus-containing compound, and the phosphorus-containing compound is a polymer including: a phosphorus-oxoacid moiety; a photo-reactive moiety; and a lubricative moiety including at least one element selected from a group consisting of fluorine and silicon, at side chains.

In another embodiment, the polymer may be a graft polymer.

In another embodiment, the phosphorus-oxoacid moiety may have a structure represented by Formula 1 below:

Formula 1

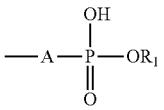

(1)

wherein $R_1$ includes at least one selected from a group consisting of an alkyl group, an aryl group, and a hydrogen atom, and A includes at least one selected from a group consisting of an oxygen atom and a methylene group.

In another embodiment, the photo-reactive moiety may have a structure represented by Formula 2 below:

Formula 2

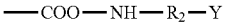

(2)

wherein $R_2$ is an alkylene group and Y is a photo-reactive functional group.

In another embodiment, the photo-reactive functional group may include at least one selected from a group consisting of an acryloyl group and a methacryloyl group.

In another embodiment, the lubricative moiety may have a structure represented by Formula 3 below:

Formula 3

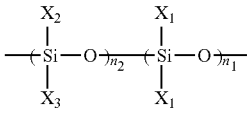

(3)

wherein $X_1$ is an alkyl group, $X_2$ includes at least one selected from a group consisting of an alkyl group and an aryl group, $X_3$ includes at least one selected from a group consisting of an alkyl group and an aryl group, $n_1$ is an integer from about 1 to about 500, and $n_2$ is an integer from about 1 to about 500.

In another embodiment, the lubricative moiety may include vinylfluoride (VF), vinylidene fluoride (VDF), tetrafluoroethylene (TFE), chlorotrifluoroethylene (CTFE), perfluoroalkoxy (PFA), fluorinated ethylene-propylene (FEP), ethylenetetrafluoroethylene (ETFE), ethylenechlorotrifluoroethylene (ECTFE), chlorotrifluoroethylenevinylidene fluoride (CTFEVF), tetrafluoroethylene-propylene (TFEP), perfluoropolyether (PFPE), perfluorosulfonic acid (PFSA), perfluoropolyoxetane (PFPO), or a combination thereof.

In another embodiment, the lubricative moiety may have a structure represented by Formula 4 below:

Formula 4

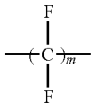

(4)

wherein m is an integer from about 1 to about 400.

In another embodiment, the phosphorus-containing compound may have a weight average molecular weight of about 300 to about 100,000.

In another embodiment, the metal oxide particles may include at least one of tin oxide, zinc oxide, and titanium oxide.

In another embodiment, the metal oxide particles may have an average primary particle diameter of about 5 nm to about 300 nm.

In another embodiment, the metal oxide particles may have an aspect ratio of about 3 or greater.

In another embodiment, the photocurable resin matrix may be an acrylic resin formed using at least one starting material selected from a group consisting of an acrylic monomer, an acrylic oligomer, and an acrylic dendrimer.

In another embodiment, the photosensitive layer may include at least one selected from a group consisting of oxotitanyl phthalocyanine and gallium phthalocyanine.

An embodiment of an electrophotographic imaging apparatus according to other aspect of the present disclosure includes: an embodiment of an electrophotographic photoreceptor according to an aspect of the present disclosure; a charging unit configured to charge the electrophotographic photoreceptor; a light image exposure unit configured to form an electrostatic latent image on the electrophotographic photoreceptor by exposing the electrophotographic photoreceptor to light; a developing unit configured to form a toner image by developing the electrostatic latent image formed on the electrophotographic photoreceptor using toner; and a cleaning unit configured to remove toner remaining on the electrophotographic photoreceptor after transferring the toner image to a transfer medium.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION

Figure 1:
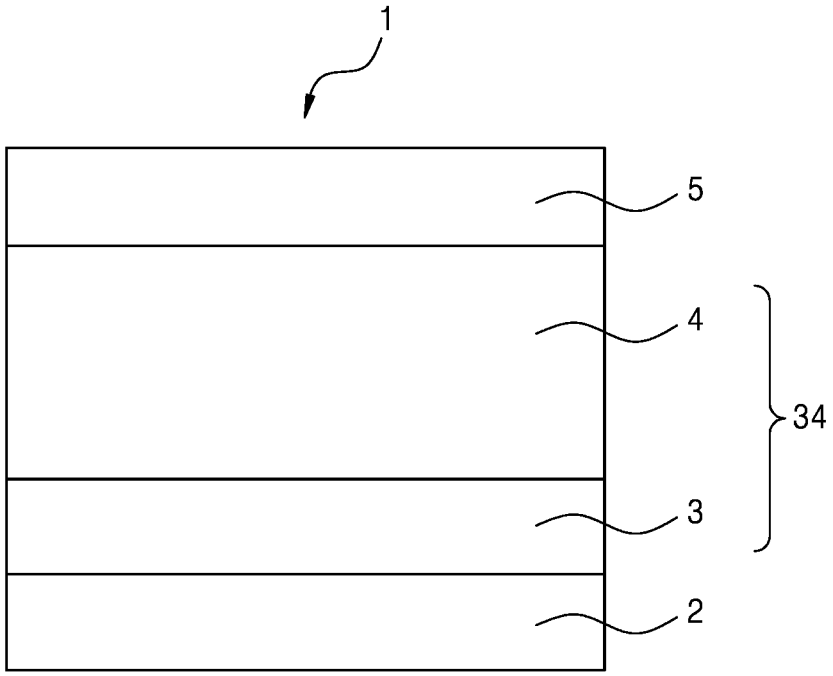
FIG. 1 is a cross-sectional view of an electrophotographic photoreceptor according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. Expressions such as "at least one of," when preceding a list of elements, modify the entire list of elements and do not modify the individual elements of the list.

Electrophotographic Photoreceptor

FIG. 1 is a cross-sectional view of an electrophotographic photoreceptor 1 according to an embodiment of the present disclosure. The electrophotographic photoreceptor 1 includes a conductive support 2, a photosensitive layer 34 formed on the conductive support 2, and a protective layer 5 formed on the photosensitive layer 34.

Conductive Support

The conductive support may be formed of any conductive material. For example, the conductive support may be obtained by molding a metal such as aluminum, copper, chromium, nickel, zinc, and stainless steel into a drum shape, a sheet shape, or a belt shape. As another example, the conductive support may be obtained by laminating a metal foil such as aluminum or copper foil on a plastic film. As another example, the conductive support may be obtained by depositing aluminum, indium oxide, or tin oxide on a plastic film. As another example, the conductive support may be obtained by coating a conductive material alone or together with a binder resin on a metal film, a plastic film, or paper.

Photosensitive Layer

The photosensitive layer may be, for example, a negatively chargeable multi-layered photosensitive layer or a positively chargeable single-layered photosensitive layer prepared by using methods well known in the art. FIG. 1 illustrates a negatively chargeable multi-layered photosensitive layer including a charge generating layer 3 and a charge transport layer 4 formed on the charge generating layer 3 as the photosensitive layer 34 disposed on the conductive support 2.

i) Negatively Chargeable Multi-Layered Photosensitive Layer

The negatively charged laminated photosensitive layer may include a charge generating layer and a charge transport layer laminated on the charge generating layer.

i-1) Charge Generating Layer

The charge generating layer is a layer including a charge generating material that generates charges as a main component and may further include a binder resin, if desired. Any known charge generating materials may be used to form the charge generating layer. Examples of the charge generating material may include monoazo pigments, disazo pigments, asymmetric disazo pigments, trisazo pigments, azo pigments having a carbazole skeleton, azo pigments having a distyryl benzene skeleton, azo pigments having a triphenylamine skeleton, azo pigments having a diphenylamine skeleton, perylene pigments, and phthalocyanine pigments. These charge generating materials may be used alone or in combination of at least two thereof. Among these materials, the charge generating layer may include at least one selected from a group consisting of oxotitanyl phthalocyanine and gallium phthalocyanine to obtain excellent electrical characteristics.

Examples of the binder resin used in the charge generating layer, if desired, may include polyamides, polyurethanes, an epoxy resin, polyketones, polycarbonates, a silicone resin, an acrylic resin, polyvinyl butyrals, polyvinyl formals, and polyvinyl ketones. These binder resins may be used alone or in combination of at least two thereof.

The charge generating material may be dispersed in a solvent together with the binder resin, if desired, by known dispersion methods using a ball mill, an attritor mill, a sand mill, a bead mill, ultrasound, and the like to obtain a coating liquid used to apply the charge generating layer to the conductive support.

The charge generating layer may have a thickness of about 0.01 μm to about 5 μm, for example, about 0.05 μm to about 3 μm.

i-2) Charge Transport Layer

The charge transport layer has a charge transporting structure and includes a charge transporting material and a binder resin as main components. The charge transport layer may include, as the charge transporting material, a hole transporting material or an electron transporting material.

Examples of the hole transporting material may include poly(N-vinylcarbazole) and derivatives thereof, poly(γ-carbazolylethylglutamate) and derivatives thereof, pyrene-formaldehyde condensates and derivatives thereof, polyvinylpyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, atphenylstilbene derivatives, aminobiphenyl derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, distyrylbenzene derivatives, and enamine derivatives. These hole transporting materials may be used alone or in combination of at least two thereof.

Examples of the binder resin may include a thermoplastic or thermosetting resin such as polystyrene, a styrene-acrylonitrile copolymer, a styrene-butadiene copolymer, a styrene-maleic anhydride copolymer, polyesters, polyvinyl chlorides, a vinyl chloride-vinyl acetate copolymer, polyvinyl acetates, a polycarbonate resin, and a polyacrylate resin.

Examples of the electron transporting material may include a benzoquinone-based, a cyanethylene-based, a cyanoquinodimethane-based, a fluorenone-based, a phenantraquinone-based, a phthalic anhydride-based, a thiopyrane-based, a naphthalene-based, a diphenoquinone-based, and a stilbenequinone-based compound. The electron transporting material may be an electron receiving material such as chloroanil, bromanil, tetracyanoethylene, tetracyanoquinodimethane, and 7-trinitro-9-fluorenone. These electron transporting materials may be used alone or in combination of at least two thereof.

The charge transporting material and the binder resin are dissolved in a solvent to obtain a coating liquid used to apply the charge transport layer to the conductive support.

The charge transport layer may have a thickness of about 5 μm to about 40 μm, for example, about 10 μm to about 35 μm.

ii) Positively Chargeable Single-Layered Photosensitive Layer

The positively chargeable single-layered photosensitive layer may have a structure in which at least one of the charge generating material, the hole transporting material, and the electron transporting material are dispersed in a single layer formed of a binder resin. Each material may be used as a single compound or as a mixture of two or more compounds, in the same manner as in the negatively chargeable laminated photosensitive layer.

The positively chargeable single-layered photosensitive layer may be formed by preparing a coating liquid by dispersing or dissolving these materials in a solvent including the binder resin in the same manner as in the negatively chargeable laminated photosensitive layer, applying the coating liquid to the conductive support, and solidifying the binder resin.

The positively chargeable single-layered photosensitive layer may have a thickness of about 5 μm to about 40 μm, for example, about 10 μm to about 35 μm.

Protective Layer

Figure 2:
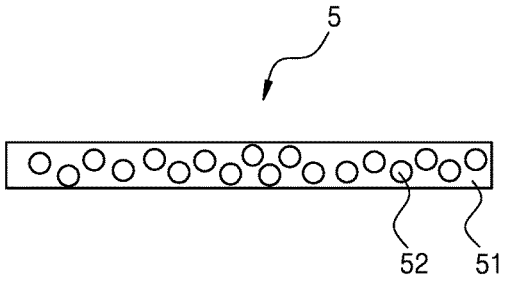
FIG. 2 is a cross-sectional view of a protective layer of the electrophotographic photoreceptor illustrated in FIG. 1.

FIG. 2 is a cross-sectional view of the protective layer according to an embodiment. The protective layer 5 includes at least a photocurable resin matrix 51 and metal oxide particles 52 dispersed in the photocurable resin matrix 51 and surface-treated with a phosphorus-containing compound.

i) Photocurable Resin Matrix

Examples of the photocurable resin may include an acrylic resin, an epoxy resin, and an oxetane resin. Also, a photocurable copolymer resin may be used. The acrylic resin may be formed using at least one starting material selected from a group consisting of an acrylic monomer, oligomer, and dendrimer. In general, when a cross-linking structure is formed via photo-polymerization of photo-functional groups in the formation of the acrylic resin, a distance between molecules is changed after a curing process. As a result, relatively considerable curing shrinkage may occur in the photocurable resin. If photocurable resins having this property are used in the protective layer of the electrophotographic photoreceptor, the protective layer has very high internal stress, high hardness, and high brittleness. Thus, when the photoreceptor has a partial defect such as a scratch on the surface thereof, the scratch or crack on the surface of the photoreceptor propagates, thereby deteriorating mechanical durability thereof. If there is a high possibility that the electrophotographic photoreceptor has this property, the photocurable resin used in this embodiment may include a dendrimer as a starting material. Dendrimers bind to each other to form a spherical structure having an inner portion with high binding density and an outer portion with low binding density. Thus, by using a dendrimer as a starting material, the internal stress may be reduced, so that the photocurable resin may have both of hardness and flexibility. Accordingly, the protective layer may have improved scratch resistance and reduced brittleness throughout the entire structure thereof. That is, when the dendrimer is added to a mixture including at least one selected from a group consisting of the acrylic monomer and oligomer, a high Martens hardness may be obtained and abrasion resistance may be improved. Each of the acrylic monomer, oligomer and dendrimer may have three or more functional groups including at least one selected from the group consisting of an acryloyl group and a methacryloyl group, i.e., may be radical polymerizable compounds having three or more functional groups. Examples of the acrylic monomer may include ditrimethylolpropane tetraacrylate, dipentaerythritol pentaacrylate, and trimethylolpropane triacrylate. The acrylic oligomer may have a number average molecular weight of about 170 to about 2000, and examples thereof may include urethane acrylate oligomer, epoxy acrylate oligomer, and polyester acrylate oligomer. The acrylic dendrimer may have a weight average molecular weight of about 1000 to about 25000 and a single molecular weight peak. The acrylic dendrimer may be either polyester acrylates or copolymerized polyacrylates. Copolymerized polyacrylates may be, for example, a cross-linkable polymer having two or more epoxy groups in a molecule. For example, polyacrylates obtained via copolymerization of glycidyl acrylate may be used. The epoxy resin may be formed using a starting material including 3,4-epoxycyclohexylmethyl-3',4'-epoxycyclohexanecarboxylate, 1,2,8,9-diepoxylimonene, bis(3,4-epoxycyclohexylmethyl)adipate, and the like.

ii) Phosphorus-Containing Compound

The phosphorus-containing compound used herein has a phosphorus-oxoacid moiety. The phosphorus-oxoacid moiety may have an oxo group directly binding to a phosphorus atom and two hydroxyl groups. According to an embodiment, a hydrogen atom contained in one of the two hydroxyl groups may be substituted with an organic group. Thus, when the phosphorus atom of the oxoacid moiety binds to an organic group via another oxygen atom that is contained neither in the oxo group nor the hydroxyl group, the phosphorus-containing compound is a phosphoric acid ester compound. In addition, if the phosphorus atom of the oxoacid moiety binds to another organic group via a carbon atom, the phosphorus-containing compound used herein is an organophosphorus compound.

Figure 3:
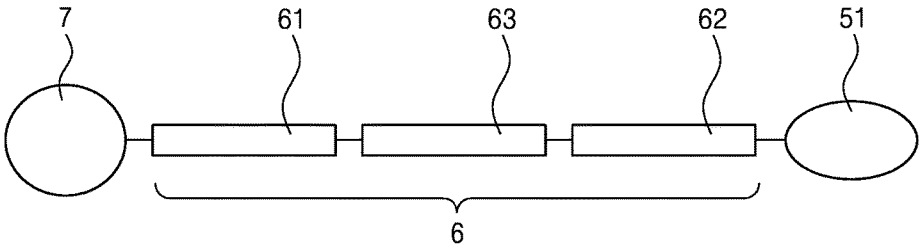
FIG. 3 is a view illustrating a schematic structure of a phosphorus-containing compound according to an embodiment.

FIG. 3 illustrates a schematic structure of a phosphorus-containing compound 6 according to an embodiment. The phosphorus-containing compound 6 includes a phosphorus-oxoacid moiety 61, a photo-reactive moiety 62, and a lubricative moiety 63. The phosphorus-oxoacid moiety 61 reacts with a metal oxide 7, and the photo-reactive moiety 62 may form a complex with the photocurable resin 51. The phosphorus-containing compound according to an embodiment is a polymer including: a phosphorus-oxoacid moiety binding to a metal oxide; a photo-reactive moiety; and a lubricative moiety having at least one selected from the group consisting of fluorine and silicon; as side chains. The phosphorus-oxoacid moiety reacts with the metal oxide by forming a covalent bond, coordinate covalent bond, hydrogen bond, electrostatic bond, and the like, thus forming a complex integrally including the metal oxide and the lubricative moiety.

The phosphorus-containing compound may be suitably used in the embodiment of the present disclosure due to stable reaction thereof although the phosphorus-containing compound is more specific to the metal oxide than a thiol-based compound, a silane-based compound, and an amine-based compound. In addition, the phosphorus-containing compound may react on the surface of the metal oxide with a high binding density.

The silane-based compound such as a silane coupling agent used in chemical modification of the metal oxide is highly reactive with a hydroxyl group. Thus, in the presence of moisture, silane coupling agents react with each other. In addition, un-reacted silane coupling agents, if remaining after a desired reaction is terminated, react with other substances having hydroxyl groups. If such reactions occur, it is difficult to prepare a stable electrophotographic photoreceptor having constant performance.

A polymer of the phosphorus-containing compound used herein may have an acryl-, epoxy-, or oxetane-based main chain. When the acrylic resin is used as the photocurable resin, a polymer having an acrylic main chain may be used. When the epoxy resin is used as the photocurable resin, a polymer having an epoxy main chain may be used. As used herein, the "acrylic main chain" refers to a skeleton structure obtained by polymerizing the acryloyl groups or the methacryloyl groups. The "epoxy main chain" refers to a skeleton structure obtained by polymerizing the epoxy groups.

The phosphorus-containing compound used herein may be a polymer having an acrylic main chain.

The polymer of the phosphorus-containing compound used herein may be a graft polymer. Effects of the lubricative moiety may be easily obtained in the graft polymer. By designing the photocurable moiety and the lubricative moiety as separate side chains, steric hindrance may be avoided in an arrangement required to obtain effects of the lubricative moiety after polymerization of the photocurable moiety and the photocurable resin.

The phosphorus-oxoacid moiety may have a structure represented by Formula 1 below.

Formula 1

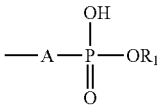

(1)

In Formula 1, $R_1$ is at least one selected from the group consisting of an alkyl group, an aryl group, and a hydrogen atom, and A is at least one selected from the group consisting of an oxygen atom and a methylene group.

The alkyl group may have 1 to 5 carbon atoms. For example, the alkyl group may be a methyl group having one carbon atom or an ethyl group having two carbon atoms. If the alkyl group is a methyl group having one carbon atom, $OR_1$ is a methoxy group in Formula 1.

For example, the aryl group may have 6 to 20 carbon atoms. The aryl group may be a phenyl group, a naphthyl group, a benzyl group, or a xylyl group.

In Formula 1, when A is an oxygen atom, the phosphorus-containing compound used herein may be a phosphoric acid ester compound regardless of $R_1$. In addition, when A is a methylene group, the phosphorus-containing compound used herein is an organophosphorus compound.

By using a hydrogen atom as $R_1$ in Formula 1, the phosphorus-containing compound may react on the surface of the metal oxide at a high binding density.

For example, when A is an oxygen atom and $R_1$ is a hydrogen atom in Formula 1, the phosphorus-oxoacid moiety according to the embodiment includes a phosphoric acid group that is also a phosphoric acid ester moiety.

Figure 4:
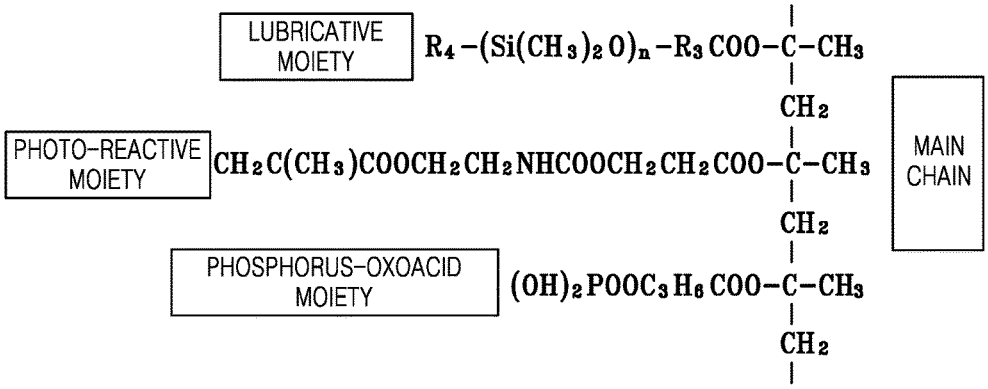
FIG. 4 is a view illustrating a molecular structure of a phosphoric acid ester compound which is an example of a silicon-based phosphorous-containing compound.
Figure 5:
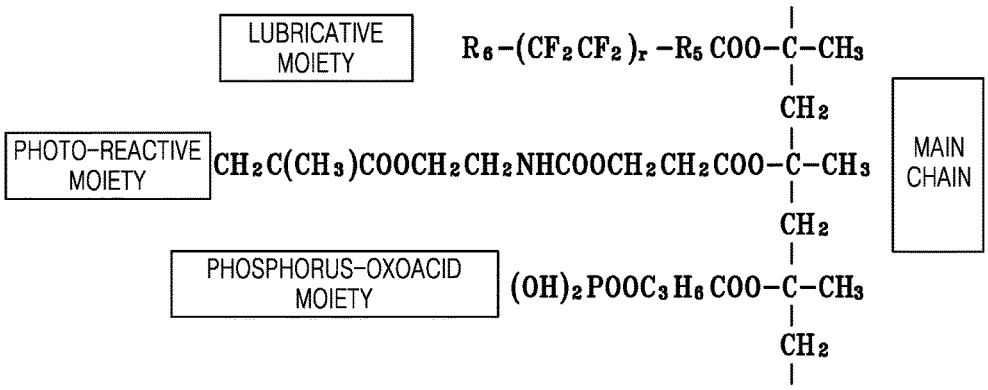
FIG. 5 is a view of a molecular structure of a phosphoric acid ester compound which is an example of a fluorine-based phosphorous-containing compound.

In addition, the phosphoric acid group may bind to the acrylic main chain via a hydrocarbon group, for example, an alkylene group that is a saturated hydrocarbon group. The alkylene group may have 1 to 5 carbon atoms. In FIGS. 4 and 5, which will be described later, a propylene group located between —COO of the main chain and a phosphoric acid group is illustrated as the alkylene group.

If A is a methylene group in the moiety of Formula 1, the methylene group may bind to the acrylic main chain via an additional hydrocarbon group, for example, an alkylene group that is a saturated hydrocarbon group. The alkylene group may have 1 to 20 carbon atoms. In addition, if the hydrocarbon group is an alkylene group, the phosphorus atom constituting the phosphorus-oxoacid moiety binds to the alkylene group having one more carbon atom since the methylene group is added to the additional alkylene group.

The photo-reactive moiety is a moiety having a photo-reactive functional group. For example, the photo-reactive moiety may include a structure represented by Formula 2 below. When the photo-reactive moiety includes the structure of Formula 2, a graft polymer may be easily formed.

Formula 2

$$\text{—COO—NH—}R_2\text{—Y} \tag{2}$$

In Formula 2, R2 is an alkylene group and Y is a photo-reactive functional group. The alkylene group of R2 may be a group having 1 to 5 carbon atoms, for example, an ethylene group. The moiety of Formula 2 may bind to the acrylic main chain via the alkylene group, and the alkylene group may have 1 to 5 carbon atoms. In FIGS. 4 and 5, which will be described later, an ethylene group located between a —COO group of the main chain and a —COO group adjacent to an NH group is illustrated as the alkylene group.

Examples of the photo-reactive functional group include an acrylic functional group, an epoxy group, an oxetane group, and the like. If the acrylic resin is used as the photocurable resin, an acrylic photo-reactive functional group may be used. If the epoxy resin is used as the photocurable resin, the photo-reactive functional group may be an epoxy group. By combining as described above, cross-linking between the photo-reactive functional group and the photocurable resin may be facilitated. The acrylic photo-reactive functional group may be an acryloyl group (CH2CHCOO—) and a methacryloyl group (CH2C(CH3)COO—).

The lubricative moiety includes at least one element selected from the group consisting of silicon and fluorine. For example, the lubricative moiety including silicon may have a structure represented by Formula 3 below.

Formula 3

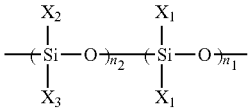

(3)

In Formula 3, X1 is an alkyl group, X2 includes at least one selected from the group consisting of an alkyl group and an aryl group, and X3 includes at least one selected from the group consisting of an alkyl group and an aryl group. Here, n1 is an integer from 1 to 500, for example, from 1 to 300. More particularly, n1 may be an integer from 10 to 200. Here, n2 may be an integer from 1 to 500, for example, from 1 to 300, more particularly, from 10 to 200. For example, the alkyl group of X1 may have 1 to 3 carbon atoms. The alkyl group of X2 may have 1 to 3 carbon atoms. For example, the aryl group of X2 may have 6 to 12 carbon atoms. The aryl group of X2 may be a phenyl group or a benzyl group. In addition, the alkyl group of X3 may have 1 to 3 carbon atoms. For example, the aryl group of X3 may have 6 to 12 carbon atoms. The aryl group of X3 may be a phenyl group of a benzyl group. To improve lubricity, all of the X1, X2, and X3 may be methyl groups; X1 may be a methyl group and X2 and X3 may be phenyl groups; or X1 and X2 may be methyl groups and X3 may be a phenyl group. They may not deteriorate electrical characteristics of the photoreceptor. When all of the X1, X2, and X3 are methyl groups, Formula 3 may be referred to as a dimethyl silicone type. When X1 is a methyl group and X2 and X3 are phenyl groups, or when X1 and X2 are methyl groups and X3 is a phenyl group, Formula 3 may be referred to as a methylphenyl silicone type. The moiety represented by Formula 3 may bind to the acrylic main chain via the alkylene group, which will be illustrated as R3 in FIG. 4 and may have 1 to 5 carbon atoms. In addition, an end group of the lubricative moiety including silicon may be a methyl group, a tert-butyl group, and the like. The end group of the lubricative moiety including silicon is illustrated as R4 in FIG. 4.

Examples of the lubricative moiety including fluorine may include vinylfluoride (VF), vinylidene fluoride (VDF), tetrafluoroethylene (TFE), chlorotrifluoroethylene (CTFE), perfluoroalkoxy (PFA), fluorinated ethylene-propylene (FEP), ethylenetetrafluoroethylene (ETFE), ethylenechlorotrifluoroethylene (ECTFE), chlorotrifluoroethylenevinylidene fluoride (CTFEVF), tetrafluoroethylene-propylene (TFEP), perfluoropolyether (PFPE), perfluorosulfonic acid (PFSA), perfluoropolyoxetane (PFPO), or any combination thereof.

The lubricative moiety including fluorine may have a structure represented by Formula 4 below.

Formula 4

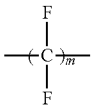

(4)

In Formula 4, m may be an integer from 1 to 400, for example, from 1 to 100, more particularly, from 1 to 20. The moiety represented by Formula 4 included in the lubricative moiety may not deteriorate electrical characteristics of the photoreceptor. When the lubricative moiety includes —$CF_2$—$CF_2$— as a repeating unit, Formula 4 may be referred to as a polytetrafluoroethylene (PTFE) type. The moiety represented by Formula 4 may bind to the acrylic main chain via the alkylene group, and the alkylene group is illustrated as $R_5$ in FIG. 5 which will be described later and may have 1 to 5 carbon atoms. In addition, the end group of the lubricative moiety including fluorine may be a fluoro group (F—), H—, or the like. The end group of the lubricative moiety including fluorine is illustrated as $R_6$ in FIG. 5.

The phosphorus-containing compound may have a weight average molecular weight of about 300 to about 120,000, for example, about 300 to about 100,000, and for example, about 5,000 to about 20,000. As the weight average molecular weight increases, viscosity increases, thereby causing adverse effects during coating. In addition, the curing process of the photocurable resin may be adversely influenced. On the other hand, as the weight average molecular weight decreases, a length of the lubricative moiety decreases, thereby obtaining insufficient lubricative effects. In addition, insufficient entanglement with the photocurable resin may be caused, which may result in bleeding on the surface of the photoreceptor. The phosphorus-containing compound may have a polydispersity index of 1 to 5.

When the phosphorus-containing compound including a lubricative moiety having silicon is a phosphoric acid ester compound, a molecular structure thereof is exemplarily illustrated in FIG. 4. When the phosphorus-containing compound including a lubricative moiety having fluorine is a phosphoric acid ester compound, a molecular structure thereof is exemplarily illustrated in FIG. 5. The phosphoric acid ester compound illustrated in FIG. 4 is a graft polymer including an acrylic main chain and side chains of a dimethyl silicone type lubricative moiety, a photo-reactive moiety having an acrylic photo-reactive functional group, and a phosphorus-oxoacid moiety having a phosphoric acid group, which is also a phosphoric acid ester moiety. In FIG. 4, n is a value of $n_1+n_2$ of FIG. 3. The phosphoric acid ester compound illustrated in FIG. 5 is a graft polymer including an acrylic main chain and side chains of a PTFE type lubricative moiety, a photo-reactive moiety having an acrylic photo-reactive functional group, and a phosphorus-oxoacid moiety having a phosphoric acid group, which is also a phosphoric acid ester moiety. In FIG. 5, r is an integer from 1 to 400. In addition, although the phosphorus-oxoacid moiety, the photo-reactive moiety, and the lubricative moiety are illustrated in this order, the embodiment is not limited thereto. The listing order thereof may be changed or the phosphorus-oxoacid moiety, the photo-reactive moiety, and the lubricative moiety may be randomly connected thereto. In addition, each of the phosphorus-oxoacid moiety, the photo-reactive moiety, and the lubricative moiety may be continuously repeated.

Since the phosphorus-containing compound according to the present embodiment binds to the metal oxide particles and forms a complex therewith in the protective layer of the electrophotographic photoreceptor, the phosphorus-containing compound is uniformly dispersed therein together with the metal oxide particles. Furthermore, since the phosphorus-containing compound according to the present embodiment includes the photo-reactive moiety cross-linkable with the photocurable resin matrix, the phosphorus-containing compound is uniformly fixed (cross-linked) in the protective layer. Accordingly, the lubricative moiety of the phosphorus-containing compound is uniformly fixed in the protective layer, so that lubricity of the protective layer may be maintained even when the surface of the protective layer is worn out. Thus, cleaning performance of the photoreceptor may be maintained. In addition, since the phosphorus-containing compound is cross-linked with the photocurable resin, surface segregation may not occur.

Furthermore, via cross-linking between the phosphorus-containing compound and the photocurable resin, the mechanical strength of the protective layer may be maintained and the packing property to protect the bottom layer of the protective layer from oxygen gas or moisture may be maintained. Also, since the phosphorus-containing compound according to the present embodiment has the photo-reactive moiety or the phosphorus-oxoacid moiety as a side chain, the number of moieties per one molecule increases. Thus, the phosphorus-containing compound may be cross-linked with the photocurable resin more strongly or bind to (react with) the metal oxide more strongly.

iv) Metal Oxide Particles

The metal oxide particles may include tin oxide, zinc oxide, titanium oxide, zirconium oxide, indium oxide, antimony oxide, bismuth oxide, calcium oxide, antimony-doped tin oxide, phosphorus-doped tin oxide, tin-doped indium oxide, or any combination thereof to improve abrasion resistance. Besides, various other metal oxide particles may also be used. The metal oxide may include at least one selected from the group consisting of tin oxide, zinc oxide, and titanium oxide to obtain a resistance value suitable for hole transporting and to inhibit residual potential from increasing.

According to an embodiment, the metal oxide particles include phosphorus-doped tin oxide. Since the phosphorus-oxoacid moiety of the phosphorus-containing compound uniformly binds to the surface of the phosphorus-doped tin oxide particles at a high binding density, effects of the lubricative moiety may be sufficiently obtained.

The metal oxide particles may have a average primary particle diameter of about 5 nm to about 300 nm. The average primary particle diameter may be acquired by calculating an average length between the longest axis length and the shortest axis length of each metal oxide particle from an image obtained using a scanning electron microscope and calculating an average of the average lengths for 100 particles. As the particle diameter of the metal oxide increases, image quality may deteriorate. In addition, as the particle diameter of the metal oxide particles decreases, their agglomerating tendency increases to decrease abrasion resistance. The average primary particle diameter of the metal oxide particles may be in the range of about 10 to about 100 nm.

The metal oxide particles may have an aspect ratio of about 3 or greater. Metal oxide particles having an aspect ratio of about 3 or greater may have acicular shapes. As the aspect ratio increases, dispersibility may decrease and coating ability may deteriorate. Thus, the aspect ratio may be about 50 or less.

A weight ratio of the metal oxide surface-treated with the phosphorus-containing compound to the photocurable resin, [metal oxide surface-treated with phosphorus-containing compound]:[photocurable resin], may be in the range of about 1:100 to about 100:100, for example, in the range of about 5:100 to about 80:100. As the amount of the metal oxide with respect to the photocurable resin increases, charging performance may deteriorate and image defects such as dark spots or image shaking may occur. On the other hand, as the amount of the metal oxide with respect to the photocurable resin decreases, sensitivity may deteriorate.

Hereinafter, a method of preparing a phosphoric acid ester compound as an example of the phosphorus-containing compound and a method of treating the surface of the metal oxide, according to an embodiment, will be described with reference to FIG. 6.

First, a surface treating agent (i.e., phosphorus-containing compound) is prepared to treat the surface of the metal oxide. At least one selected from the group consisting of acrylate and methacrylate having a phosphorus-oxoacid moiety having a phosphoric acid group, which is also a phosphoric acid ester moiety, at least one selected from the group consisting of acrylate and methacrylate having an isocyanate having a photo-reactive moiety and a urethane-binding functional group, at least one selected from the group consisting of acrylate and methacrylate including a lubricative moiety, and a polymerization initiator, if desired, were subjected to polymerization in the presence of a solvent in an inert gas atmosphere (first stage of polymerization in FIG. 6). Then, the isocyanate having a photo-reactive moiety is added thereto, and polymerization is performed in the presence of a catalyst (second stage of polymerization in FIG. 6). Accordingly, a surface treating agent including a phosphoric acid ester compound having an acrylic main chain may be obtained. Reaction conditions for the first stage of polymerization may include, for example, a reaction temperature in the range of about 40° C. to about 120° C. and a reaction time in the range of about 1 hour to about 12 hours.

Examples of the acrylate and methacrylate having a phosphorus-oxoacid moiety may include acidphosphooxyethyl methacrylate and acidphosphooxy ethylene glycol monomethacrylate. Examples of the acrylate and methacrylate having an isocyanate having a photo-reactive moiety and a urethane-binding functional group may include 2-hydroxyethyl methacrylate (HEMA), 4-hydroxybutyl acrylate, and 2-hydroxypropyl methacrylate. Examples of the acrylate and methacrylate having a lubricative moiety may include acryl-modified or methacryl-modified reactive silicone oil in case the lubricative moiety includes silicon and octafluoropentyl acrylate, or 2,2,2-trifluoroethyl acrylate represented by Formula 5 below in case the lubricative moiety includes fluorine.

Formula 5

(5)

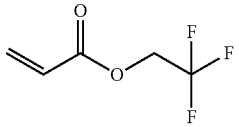

Examples of the polymerization initiator may include azobisisobutyronitrile (AIBN), 2,2'-azobis-2-methylbutyronitrile (AMBN), and 2,2'-azobis-2,4-dimethylvaleronitrile (ADVN). Examples of the solvent may include diethylene glycol ethylmethyl ether, dimethyl sulfoxide, and toluene. Examples of the isocyanate having a photo-reactive moiety may include 2-isocyanateethyl methacrylate and 2-isocyanateethyl acrylate. Examples of the catalyst may include dibutyl tin dilaurate, dibutyl tin diacetate, and triphenylphosphine.

The prepared surface treating agent and the metal oxide may be dispersed in a dispersion solvent by using a sand mill, or the like to obtain a solution including the surface-treated metal oxide. Examples of the dispersion solvent may include methanol, n-propanol, and any mixture thereof. The solution including the prepared surface-treated metal oxide may constitute a protective layer coating solution together with a starting material of the photocurable resin and other materials, for example, a polymerization initiator, and a solvent. In this case, examples of the polymerization initiator may include a variety of radical-type photo-polymerization initiators such as α-aminoalkyl phenone-based, α-hydroxyalkyl phenone-based, and an oxime ester-based photo-polymerization initiators. The afore-mentioned dispersion solvent may also be used as the solvent.

In the protective layer coating solution, metal oxide particles surface-treated with the phosphorus-containing compound are uniformly dispersed. In addition, since the phosphorus-containing compound used herein forms a complex with the metal oxide, it may also be dispersed as the metal oxide. This indicates that the lubricative moiety contained in the phosphorus-containing compound is uniformly dispersed therein. Advantages according to the present disclosure result from uniform dispersibility of the metal oxide surface-treated with the phosphorus-containing compound.

Figure 6:
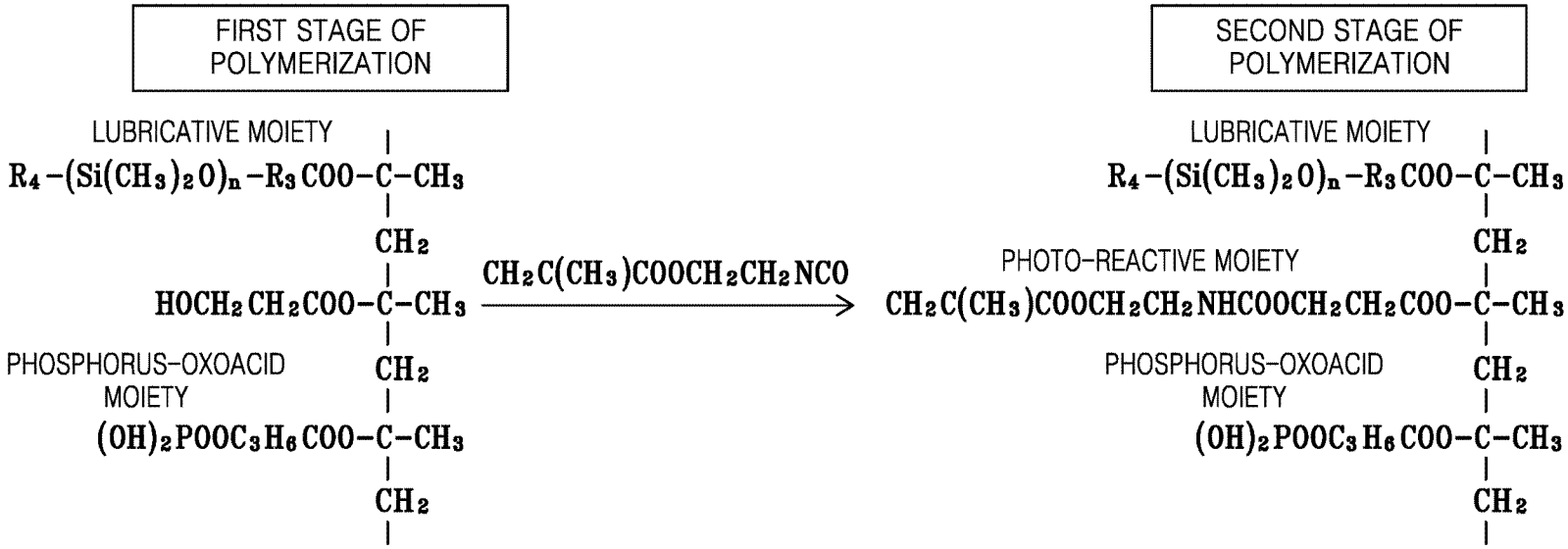
FIG. 6 is a view illustrating polymerization to prepare a phosphoric acid ester compound which is an example of a silicon-based phosphorous-containing compound as shown in FIG. 4.

FIG. 6 illustrates a polymerization reaction performed when acidphosphooxyethyl methacrylate is used as a methacrylate having a phosphorus-oxoacid moiety having a phosphoric acid group, which is a phosphoric acid ester moiety, HEMA is used as a methacrylate having an isocyanate having a photo-reactive moiety and a urethane-binding functional group, a methacrylic-modified mono-terminal type reactive silicone oil is used as a methacrylate having a lubricative moiety, and 2-isocyanateethyl methacrylate is used as an isocyanate including a photo-reactive moiety. In the second stage of polymerization, a hydroxyl group of HEMA and an isocyanate group of the isocyanate form a urethane bond.

Although the method of preparing the phosphorus-containing compound having an acrylic main chain is described above, the phosphorus-containing compound having an epoxy main chain may also be prepared by using, for example, epoxy-based starting materials respectively having a phosphorus-oxoacid moiety, a photo-reactive moiety, and a lubricative moiety, and via ring-opening polymerization of the epoxy groups.

The protective layer may further include a charge transporting material. Residual potential may be decreased and sensitivity degradation may be inhibited, by adding the charge transporting material to the protective layer. All charge transporting materials used in the charge transport layer and described above may also be used in the protective layer.

The protective layer may have a thickness of about 0.1 μm to about 10 μm, for example, about 1 μm to about 7 μm.

The protective layer may be prepared by curing the protective layer coating solution. The protective layer coating solution may be cured by generating radical polymerization via actinic radiation and forming cross-linking bonds between molecules. Although the actinic radiation may be performed by an electron beam and ultraviolet radiation, ultraviolet radiation may be used for mass production. A metal halide lamp, a mercury lamp, a UV LED, and the like may be used as a radiation device.

Intermediate Layer

An intermediate layer may be installed between the conductive support and the photosensitive layer. The intermediate layer functions as a barrier layer or an adhesion layer to control injection of charges in the interface therebetween. Although the intermediate layer includes a binder resin as a main component, it may also include a metal, an alloy, or oxides thereof, salts, and surfactants. Examples of the binder resin forming the intermediate layer may include polyesters, polyurethanes, polyarylates, polyethylenes, polystyrenes, polybutadienes, polycarbonates, polyamides, polypropylenes, polyimides, a phenol resin, an acrylic resin, a silicone resin, an epoxy resin, a urea resin, an allyl resin, an alkyd resin, polyamideimides, polysulfones, polyallylethers, polyacetals, and a butyral resin. The intermediate layer may have a thickness of about 0.05 μm to about 7 μm, for example, about 0.1 μm to about 2 μm.

The photosensitive layer and the protective layer, and if desired, the intermediate layer may be applied to the conductive support by using known coating methods. Particularly, blade coating, dip coating, and spray coating may be used.

As described above, the protective layer 5 of the electrophotographic photoreceptor 1 according to the present embodiment may include the metal oxide particles 52 surface-treated with the phosphorus-containing compound 6, which is a polymer including the phosphorus-oxoacid moiety 61 reacting with a metal oxide, the photo-reactive moiety 62, and the lubricative moiety 63 as side chains, and the photocurable resin 51. Thus, the photo-reactive moiety of the metal oxide surface-treated with the phosphorus-containing compound may be cross-linked with the photocurable resin. It also indicates that the lubricative moiety contained in the phosphorus-containing compound is fixed in a uniformly dispersed state in the protective layer together with the metal oxide. Thus, surface segregation that often occurs in silicone oil conventionally used as a lubricant may be prevented. In addition, even when the surface of the protective layer slowly wears out while using the electrophotographic photoreceptor, lubricity does not deteriorate for a long time and high cleaning performance may be maintained for a long time. Furthermore, the cross-linking structure of the photo-reactive moiety and the photocurable resin may improve the strength of the protective layer. As a result, the electrophotographic photoreceptor may have excellent durability.

Electrophotographic Imaging Apparatus

The electrophotographic imaging apparatus according to an embodiment includes the electrophotographic photoreceptor according to an embodiment of the present disclosure, a charging unit that charges the outer surface of the electrophotographic photoreceptor, an image exposure unit, a developing unit, and a cleaning unit. Hereinafter, this will be described with reference to FIG. 7.

Figure 7:
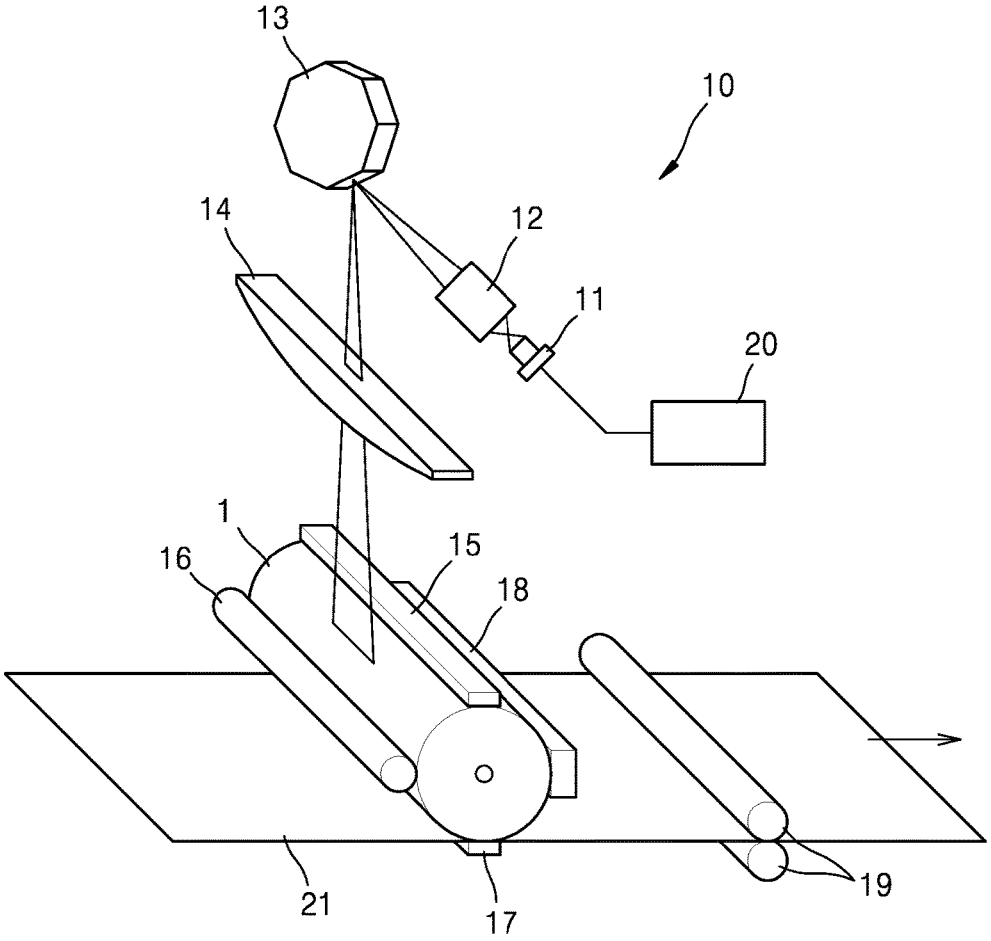
FIG. 7 is a schematic view of an electrophotographic imaging apparatus according to an embodiment.

FIG. 7 is a schematic view of an electrophotographic imaging apparatus 10 according to an embodiment of the present disclosure. The electrophotographic imaging apparatus 10 includes a semiconductor laser (image exposure device) 11 as the image exposure unit. Projected laser beams are modulated by a control circuit 20 in accordance with image information, and parallelized by a correction optical system 12, reflected by a rotational polygon mirror 13, and move in a scanning motion. The laser beams are focused on the surface of the electrophotographic photoreceptor 1 by using a f-θ lens 14 to perform exposure of image information. Since the electrophotographic photoreceptor 1 is charged in advance by the charging device 15, an electrostatic latent image is formed by light exposure. Then, the electrostatic latent image formed on the electrophotographic photoreceptor 1 is developed by a developing device 16 using toner to form toner image, thereby visualizing an image. A visual image is transferred to an image receptor 21 such as paper by a transfer device 17 and fixed by a fixing device 19 to be provided as a printed image. The electrophotographic photoreceptor 1 may be repeatedly used by removing toner or toner components remaining on the surface thereof by a cleaning device 18.

As illustrated in FIG. 7, the electrophotographic photoreceptor 1 having a drum shape rotates about a shaft at a predetermined speed. The outer surface of the electrophotographic photoreceptor 1 is uniformly charged by the charging unit with a positive or negative predetermined uniform charge while rotating. For example, a vibration voltage obtained by superimposing AC voltage on DC voltage may be applied thereto. Although the electrophotographic photoreceptor having a drum shape is described herein, an electrophotographic photoreceptor having a sheet shape or belt shape may also be used.

The charging device 15 is a contact type charging device that supplies charges by bringing a charging member such as a charging roller or a charging brush into contact with the photoreceptor. In addition to the charging device 15 illustrated in FIG. 7, a non-contact type charging roller or a scorotron charging device or corotron charging device using corona discharge may be used as the charging unit.

Furthermore, a plurality of components among the electrophotographic photoreceptor, the charging unit, and the developing unit of the electrophotographic imaging apparatus may be integrated into a process cartridge, and the process cartridge may be detachably coupled to a main body of the electrophotographic imaging apparatus such as a photocopier or a laser beam printer.

As described above, since the electrophotographic imaging apparatus 10 according to the present embodiment includes the electrophotographic photoreceptor 1 having excellent durability, lubricity of the surface is maintained even after the surface of the photoreceptor slowly peels when in use. Thus, the electrophotographic photoreceptor 1 may have excellent cleaning performance for a long time. Thus, the cleaning unit is hardly damaged and not only the electrophotographic photoreceptor but also the cleaning unit may be used for a long time, so that the electrophotographic imaging apparatus has a long lifespan.

According to another embodiment of the present disclosure, a method of preparing an electrophotographic photoreceptor having excellent cleaning performance and high durability for a long time is provided.

The method of preparing the electrophotographic photoreceptor may include a process of forming the photosensitive layer on the conductive support, and a process of forming the protective layer on the photosensitive layer. The protective layer is formed by curing the metal oxide surface-treated with the phosphorus-containing compound and the photocurable resin. The surface-treatment is performed by mixing the phosphorus-containing compound with the metal oxide. The phosphorus-containing compound is a polymer having side chains including a phosphorus-oxoacid moiety reacting with the metal oxide, a photo-reactive moiety, and a lubricative moiety including at least one of fluorine and silicon. The metal oxide includes at least one selected from a group consisting of tin oxide, zinc oxide, and titanium oxide.

In addition, when the photosensitive layer is a negatively charged laminated type, a process of forming the photosensitive layer includes a process of forming the charge generating layer on the conductive support and a process of forming the charge transport layer on the charge generating layer.

According to another embodiment of the present disclosure, a method of preparing an electrophotographic imaging apparatus having excellent cleaning performance and high durability for a long time is provided. The method of preparing the electrophotographic imaging apparatus according to the present disclosure may be achieved by using the electrophotographic photoreceptor according to the present disclosure.

That is, the method of preparing the electrophotographic imaging apparatus may be achieved by combining the electrophotographic photoreceptor according to the present disclosure with the charging device functioning as the charging unit, the exposure device functioning as the image exposure unit, the developing device functioning as the developing unit, and the cleaning device functioning as the cleaning unit.

EXAMPLES

Hereinafter, one or more embodiments will be described in detail with reference to the following synthesis examples and examples.

Preparation Example 1

A photoreceptor was prepared in the following order.

(Conductive Support)

An aluminum tube having an external diameter of 30 mm was used as a conductive support.

(Intermediate Layer)

Materials listed below were dispersed using a bead mill for 5 hours. CM8000 (Toray Industries, Inc.) was used as a polyamide resin and MT-500SA (Tayca Corporation) was used as titanium oxide.

| | |
|---|---|
| Polyamide resin | 5 parts by weight |
| Titanium oxide | 5 parts by weight |
| Methanol | 50 parts by weight |
| n-propanol | 10 parts by weight |

The thus prepared dispersion was coated on the conductive support by dip coating to form an intermediate layer having a thickness of 1 μm.

(Charge Generating Layer)

Materials listed below were dispersed using a bead mill for 3 hours. BX-5 (Sekisui Chemical Co., Ltd.) was used as a butyral resin.

| | |
|---|---|
| Oxotitanyl phthalocyanine pigment (Y type) | 10 parts by weight |
| Butyral resin | 10 parts by weight |
| 1,2-dimethoxyethane | 900 parts by weight |
| Cyclohexanone | 100 parts by weight |

The thus prepared dispersion was coated on the conductive support, on which the intermediate layer had been formed, by dip coating to form a charge generating layer having a thickness of 0.2 μm.

(Charge Transport Layer)

Materials listed below were mixed with and dissolved in 100 parts by weight of tetrahydrofurane (THF). PCZ-500 (Mitsubishi Gas Chemical Company, Inc.) was used as polycarbonate.

| | |
|---|---|
| Charge transporting material: 1,1-bis(4-diethylaminophenyl)-4,4-diphenyl-1,3-butadiene | 10 parts by weight |
| Binder resin: polycarbonate | 10 parts by weight |
| Anti-oxidant: dibutyl hydroxy toluene (BHT) | 0.1 parts by weight |

The thus prepared solution was coated on the conductive support, on which the charge generating layer had been formed as described above, by dip coating to form a charge transport layer having a thickness of 20 μm. Then, the resultant was dried at 135° C. for 30 minutes. Thus, a photosensitive layer, in which the charge transport layer is laminated on the charge generating layer, was prepared.

(Protective Layer)

Acidphosphooxyethyl methacrylate [Phosmer M (manufactured by Uni Chemical Co., Ltd.)] was used as Component A, 2-hydroxyethyl methacrylate (HEMA) [manufactured by Tokyo Chemical Industry] was used as Component B, and mono-terminal type reactive silicone oil [X-22-174DX (manufactured by Shin-Etsu Silicone)] was used as Component C. They were prepared such that a molar ratio of Component A:Component B:Component C was 30:40:30.5 parts by weight of AIBN was used as an initiator based on 100 parts by weight of the total weight of these three components. Diethylene glycol ethylmethyl ether was added thereto such that a solid content of Components A to C and AIBN was 15% by weight, and polymerization was performed while stirring under nitrogen substitution at 70° C. for 4 hours to obtain Reaction Solution 1.

2-isocyanateethyl methacrylate [Karenz MOI (manufactured by Showa Denko)] in an amount of the same moles as HEMA was added to 100 parts by weight of Reaction Solution 1, and 10 parts by weight of dibutyltin dilaurate was added thereto as a catalyst. The mixture was maintained at 65° C. while stirring. In order to identify a reaction between hydroxyl groups of HEMA and isocyanate groups of 2-isocyanateethyl methacrylate, the peak reduction of isocyanate was identified by using Fourier-transform infrared spectroscopy (FT-IR). After 6 hours, Reaction Solution 2 (a solution including the phosphorus-containing compound according to the present disclosure), in which no peak was observed from isocyanate, was obtained. A weight average molecular weight of the obtained phosphorus-containing compound was measured by analyzing Reaction Solution 2 by using gel permeation chromatography (GPC). The results are listed in Table 1. In addition, functional groups of the photo-reactive moieties and the phosphorus-oxoacid moieties and structure types of the lubricative moieties of the phosphorus-containing compounds are shown in Table 1.

The metal oxide was surface-treated as follows.

Phosphorus-doped tin oxide (PTO) [SP-2 (manufactured by Mitsubishi Materials Electronic Chemicals Co., Ltd.)] was used as the metal oxide. The average primary particle diameters of the metal oxides are shown in Table 1. A mixture of methanol and n-propanol mixed in a weight ratio of 7:3 was used as a dispersion solvent. These materials were mixed with Reaction Solution 2 in the following ratio and dispersed using a sand mill for 6 hours.

| | |
|---|---|
| Reaction Solution 2 | 0.1 parts by weight |
| Metal oxide | 10 parts by weight |
| Dispersion solvent | 40 parts by weight |

The thus prepared solution included 20% by weight of surface-treated PTO as solids and was used as a PTO solution (solution of metal oxide surface-treated with phosphorus-containing compound).

In addition, the average primary particle diameter was calculated by projecting a photograph of particles enlarged by a scanning electron microscope (manufactured by Nippon Electronics Ltd.), and scanning the photograph by a scanner, and then, analyzing the scanned image by an image analyzing software.

A protective layer was formed as follows.

2-methyl-1-(4-methylthiophenyl)-2-morpholinopropan-1-one [Irgacure907 (manufactured by Chiba Japan Co., Ltd.)] was used as a polymerization initiator, urethane acrylate oligomer [UV-7605B (manufactured by Nippon Synthetic Chemical Industry Co., Ltd.)] (weight average molecular weight: 1100 and number average molecular weight: 800) was used as a photocurable resin, and a mixture of methanol and n-propanol mixed in a weight ratio of 7:3 was used as a dispersion solvent. These materials were mixed with 10 parts by weight of the PTO solution in the following ratio and mixed while stirring under dark conditions to prepare a protective layer coating solution.

| | |
|---|---|
| Polymerization initiator | 0.6 parts by weight |
| Photocurable resin | 10 parts by weight |
| Dispersion solvent | 42.4 parts by weight |

The protective layer coating solution was applied to the dried conductive support, on which the photosensitive layer had been formed as described above, by dip coating. After coating, the solvent was dried at 80° C. for 10 minutes. After drying, the conductive support was irradiated with a metal halide lamp of 160 W/cm at a distance of 100 mm for 1 minute while rotating the conductive support to form a protective layer having a thickness of 5 μm thereon, thereby completing preparation of a photoreceptor.

Preparation Example 2

A photoreceptor was prepared in the same manner as in Preparation Example 1, except that 2-isocyanateethyl acrylate [Karenz AOI (manufactured by Showa Denko)] was used in the preparation of Reaction Solution 2 instead of 2-isocyanateethyl methacrylate [Karenz MOI (manufactured by Showa Denko)].

Preparation Example 3

A photoreceptor was prepared in the same manner as in Preparation Example 1, except that octafluoropentyl acrylate [Viscoat 8F (manufactured by Osaka Organic Chemical Industry Ltd.)] was used in the preparation of Reaction Solution 1 instead of mono-terminal type reactive silicone oil [X-22-174DX (manufactured by Shin-Etsu Silicone)].

Preparation Example 4

A photoreceptor was prepared in the same manner as in Preparation Example 1, except that the reaction time was reduced and the weight average molecular weight of the phosphorus-containing compound was 5000 in the preparation of Reaction Solution 1.

Preparation Example 5

A photoreceptor was prepared in the same manner as in Preparation Example 1, except that antimony-doped tin oxide (ATO) [T-1 (manufactured by Mitsubishi Materials Electronic Chemicals Co., Ltd.)] was used as a metal oxide to be surface-treated, instead of PTO.

Preparation Example 6

A photoreceptor was prepared in the same manner as in Preparation Example 1, except that sol-type PTO [CX-S204IP (manufactured by Nissan Chemical Industries, Ltd.) (solid content: 20% IPA sol solution)] was used as a metal oxide to be surface-treated, instead of PTO [SP-2 (manufactured by Mitsubishi Materials Electronic Chemicals Co., Ltd.)], and Reaction Solution 2 and the metal oxide were mixed in the following ratio and stirred for 6 hours without using the dispersion solvent.

| | |
|---|---|
| Reaction solution 2 | 0.1 parts by weight |
| Metal oxide | 50 parts by weight (Solid content: 10 parts by weight) |

Preparation Example 7

A photoreceptor was prepared in the same manner as in Preparation Example 1, except that acicular ATO [FS-10P (manufactured by Ishihara Corporation)] was used as a metal oxide to be surface-treated, instead of PTO [SP-2 (manufactured by Mitsubishi Materials Electronic Chemicals Co., Ltd.)]. The metal oxide has a longest axial length of 0.2 μm to 2.0 μm, a shortest axial length of 0.01 μm to 0.02 μm, and an aspect ratio of 20 to 30 (In Table 1, it is indicated as "irregular" for the average primary particle diameter). The lengths were measured using a scanning electron microscope.

Preparation Example 8

A photoreceptor was prepared in the same manner as in Preparation Example 1, except that tin oxide [S-2000 (manufactured by Mitsubishi Materials Electronic Chemicals Co., Ltd.)] was used as a metal oxide to be surface-treated, instead of PTO [SP-2 (manufactured by Mitsubishi Materials Electronic Chemicals Co., Ltd.)].

Preparation Example 9

A photoreceptor was prepared in the same manner as in Preparation Example 1, except that titanium oxide [MT500B (manufactured by Tayca Corporation)] was used as a metal oxide to be surface-treated, instead of PTO [SP-2 (manufactured by Mitsubishi Materials Electronic Chemicals Co., Ltd.)].

Preparation Example 10

A photoreceptor was prepared in the same manner as in Preparation Example 1, except that antimony-doped zinc oxide (AZO) [CX-Z2101P (manufactured by Nissan Chemical Industries, Ltd.) (solid content: 20% IPA sol solution)] was used as a metal oxide to be surface-treated, instead of PTO [SP-2 (manufactured by Mitsubishi Materials Electronic Chemicals Co., Ltd.)], and Reaction Solution 2 and the metal oxide were mixed in the following ratio and stirred for 6 hours without using the dispersion solvent.

| | |
|---|---|
| Reaction solution 2 | 0.1 parts by weight |
| Metal oxide | 50 parts by weight (Solid content: 10 parts by weight) |

Preparation Example 11

A photoreceptor was prepared in the same manner as in Preparation Example 1, except that di-trimethylolpropane tetraacrylate monomer [SR355 (manufactured by Sartomer Co., Inc.)], which was a tetrafunctional acrylic monomer, was used as the photocurable resin instead of urethane acrylate oligomer [UV-7605B (manufactured by Nippon Synthetic Chemical Industry Co., Ltd.)].

Preparation Example 12

A photoreceptor was prepared in the same manner as in Preparation Example 1, except that 5 parts by weight of urethane acrylate oligomer [UV-7605B (manufactured by Nippon Synthetic Chemical Industry Co., Ltd.)] and 5 parts by weight of polyacrylate dendrimer [SIRIUS-501 (manufactured by Osaka Organic Chemical Industry Ltd.)] were used as the photocurable resin instead of 10 parts by weight of urethane acrylate oligomer [UV-7605B (manufactured by Nippon Synthetic Chemical Industry Co., Ltd.)].

Preparation Example 13

A photoreceptor was prepared in the same manner as in Preparation Example 1, except that a mixture including 4 parts by weight of urethane acrylate oligomer [UV-7605B (manufactured by Nippon Synthetic Chemical Industry Co., Ltd.)], 1 part by weight of urethane acrylate oligomer [UT-5670 (manufactured by Nippon Synthetic Chemical Industry Co., Ltd.)] and 5 parts by weight of polyacrylate dendrimer [SIRIUS-501 (manufactured by Osaka Organic Chemical Industry Ltd.)] were used as the photocurable resin instead of 10 parts by weight of urethane acrylate oligomer [UV-7605B (manufactured by Nippon Synthetic Chemical Industry Co., Ltd.)].

Preparation Example 14

A photoreceptor was prepared in the same manner as in Preparation Example 1, except that gallium phthalocyanine pigment (V type) was used as the pigment of the charge generating layer instead of oxotitanyl phthalocyanine pigment (Y type).

Preparation Example 15

A photoreceptor was prepared in the same manner as in Preparation Example 1, except that 5 parts by weight of oxotitanyl phthalocyanine pigment (Y type) and 5 parts by weight of gallium phthalocyanine pigment (V type) were used as the pigment of the charge generating layer instead of 10 parts by weight of oxotitanyl phthalocyanine pigment (Y type).

Preparation Example 16

A photoreceptor was prepared in the same manner as in Preparation Example 1, except that the metal oxide was not surface-treated, i.e., a solution including only PTO [SP-2 (manufactured by Mitsubishi Materials Electronic Chemicals Co., Ltd.)] such that a solid content was 20% by weight, was used when the protective layer coating solution is prepared instead of the PTO solution.

Preparation Example 17

A photoreceptor was prepared in the same manner as in Preparation Example 1, except that a solution including 1 part by weight of acidphosphooxyethyl methacrylate [Phosmer M (manufactured by Uni Chemical Co., Ltd.)] and the same dispersion solvent was used when the metal oxide was surface-treated, instead of 0.1 parts by weight of Reaction Solution 2.

Preparation Example 18

A photoreceptor was prepared in the same manner as in Preparation Example 1, except that the metal oxide was not surface-treated as described in Preparation Example 16, the PTO solution was not used, and 0.1 parts by weight of a bi-terminal type modified silicone [X-22-2445 (manufactured by Shin-Etsu Silicone)] was added thereto as the protective layer coating solution.

Preparation Example 19

A photoreceptor was prepared in the same manner as in Preparation Example 1, except that alumina [Sumiko Random AA-03 (manufactured by Sumitomo Chemical Co., Ltd.)] was used as a metal oxide to be surface-treated, instead of PTO [SP-2 (manufactured by Mitsubishi Materials Electronic Chemicals Co., Ltd.)].

Preparation Example 20

A photoreceptor was prepared in the same manner as in Preparation Example 1, except that silica [KMPX-100 (manufactured by Shin-Etsu Chemical Co., Ltd.)] was used as a metal oxide to be surface-treated, instead of PTO [T-1 (manufactured by Mitsubishi Materials Electronic Chemicals Co., Ltd.)].

Preparation Example 21

A photoreceptor was prepared in the same manner as in Preparation Example 1, except that the reaction time was increased and the weight average molecular weight of the phosphorus-containing compound was increased to 120,000 in the preparation of Reaction Solution 1.

Preparation Example 22

A photoreceptor was prepared in the same manner as in Preparation Example 1, except that metal-free phthalocyanine (X type) was used as the pigment of the charge generating layer instead of oxotitanyl phthalocyanine pigment (Y type).

TABLE 1

| | Metal oxide particles | | Phosphorus-containing compound | | | |
|---|---|---|---|---|---|---|
| | Type | average primary particle diameter (nm) | Photo-reactive moiety | Phosphorus-oxoacid moiety | Lubricative moiety | Weight average molecular weight |
| Preparation Example 1 | PTO | 20 | methacryloyl group | phosphoric acid group | dimethyl silicone | 20,000 |
| Preparation Example 2 | PTO | 20 | acryloyl group | phosphoric acid group | dimethyl silicone | 20,000 |
| Preparation Example 3 | PTO | 20 | methacryloyl group | phosphoric acid group | polytetra fluoroethylene | 20,000 |
| Preparation Example 4 | PTO | 20 | methacryloyl group | phosphoric acid group | dimethyl silicone | 5,000 |
| Preparation Example 5 | ATO | 20 | methacryloyl group | phosphoric acid group | dimethyl silicone | 20,000 |
| Preparation Example 6 | PTO (sol solution) | 20 | methacryloyl group | phosphoric acid group | dimethyl silicone | 20,000 |
| Preparation Example 7 | acicular ATO | irregular | methacryloyl group | phosphoric acid group | dimethyl silicone | 20,000 |
| Preparation Example 8 | tin oxide | 20 | methacryloyl group | phosphoric acid group | dimethyl silicone | 20,000 |
| Preparation Example 9 | titanium oxide | 30 | methacryloyl group | phosphoric acid group | dimethyl silicone | 20,000 |
| Preparation Example 10 | AZO | 100 | methacryloyl group | phosphoric acid group | dimethyl silicone | 20,000 |
| Preparation Example 11 | PTO | 20 | methacryloyl group | phosphoric acid group | dimethyl silicone | 20,000 |
| Preparation Example 12 | PTO | 20 | methacryloyl group | phosphoric acid group | dimethyl silicone | 20,000 |
| Preparation Example 13 | PTO | 20 | methacryloyl group | phosphoric acid group | dimethyl silicone | 20,000 |
| Preparation Example 14 | PTO | 20 | methacryloyl group | phosphoric acid group | dimethyl silicone | 20,000 |
| Preparation Example 15 | PTO | 20 | methacryloyl group | phosphoric acid group | dimethyl silicone | 20,000 |
| Preparation Example 16 | PTO | 20 | no surface-treatment | | | |
| Preparation Example 17 | PTO | 20 | methacryloyl group | phosphoric acid group | — | 20,000 |
| Preparation Example 18 | PTO | 20 | — | — | bi-terminal type modified silicone (add) | — |
| Preparation Example 19 | alumina | 30 | methacryloyl group | phosphoric acid group | dimethyl silicone | 20,000 |
| Preparation Example 20 | silica | 10 | methacryloyl group | phosphoric acid group | dimethyl silicone | 20,000 |
| Preparation Example 21 | PTO | 20 | methacryloyl group | phosphoric acid group | dimethyl silicone | 120,000 |
| Preparation Example 22 | PTO | 20 | methacryloyl group | phosphoric acid group | dimethyl silicone | 20,000 |

TABLE 2

| | Photocurable resin matrix | Charge generating layer |
|---|---|---|
| Preparation Example 1 | urethane acrylate oligomer | oxotitanyl phthalocyanine |
| Preparation Example 2 | urethane acrylate oligomer | oxotitanyl phthalocyanine |
| Preparation Example 3 | urethane acrylate oligomer | oxotitanyl phthalocyanine |
| Preparation Example 4 | urethane acrylate oligomer | oxotitanyl phthalocyanine |
| Preparation Example 5 | urethane acrylate oligomer | oxotitanyl phthalocyanine |
| Preparation Example 6 | urethane acrylate oligomer | oxotitanyl phthalocyanine |
| Preparation Example 7 | urethane acrylate oligomer | oxotitanyl phthalocyanine |
| Preparation Example 8 | urethane acrylate oligomer | oxotitanyl phthalocyanine |
| Preparation Example 9 | urethane acrylate oligomer | oxotitanyl phthalocyanine |
| Preparation Example 10 | urethane acrylate oligomer | oxotitanyl phthalocyanine |

TABLE 2-continued

| | Photocurable resin matrix | Charge generating layer |
|---|---|---|
| Preparation Example 11 | tetrafunctional acrylic monomer | oxotitanyl phthalocyanine |
| Preparation Example 12 | urethane acrylate oligomer + polyacrylate dendrimer | oxotitanyl phthalocyanine |
| Preparation Example 13 | urethane acrylate oligomer (2 types) + polyacrylate dendrimer | oxotitanyl phthalocyanine |
| Preparation Example 14 | urethane acrylate oligomer | gallium phthalocyanine |
| Preparation Example 15 | urethane acrylate oligomer | oxotitanyl phthalocyanine + gallium phthalocyanine |
| Preparation Example 16 | urethane acrylate oligomer | oxotitanyl phthalocyanine |
| Preparation Example 17 | urethane acrylate oligomer | oxotitanyl phthalocyanine |
| Preparation Example 18 | urethane acrylate oligomer | oxotitanyl phthalocyanine |
| Preparation Example 19 | urethane acrylate oligomer | oxotitanyl phthalocyanine |

TABLE 2-continued

| | Photocurable resin matrix | Charge generating layer |
|---|---|---|
| Preparation Example 20 | urethane acrylate oligomer | oxotitanyl phthalocyanine |
| Preparation Example 21 | urethane acrylate oligomer | oxotitanyl phthalocyanine |
| Preparation Example 22 | urethane acrylate oligomer | metal-free phthalocyanine |

TABLE 3-continued

| | Initial characteristics | | |
|---|---|---|---|
| | Martens hardness (mN) | Elastic modulus (%) | Water contact angle (°) |
| Preparation Example 20 | 258 | 54 | 90 |
| Preparation Example 21 | 160 | 46 | 90 |
| Preparation Example 22 | 255 | 56 | 91 |

TABLE 4

| | Evaluation results | | | | | | |
|---|---|---|---|---|---|---|---|
| | Potential (V) | | | | | | |
| | Initial VL | VL (end) (after printing) | Blade squeal | Image blurring | Cleaning performance | Scratch resistance | Thickness loss rate (nm/k OPC cycle) |
| Preparation Example 1 | 90 | 120 | ◎ | ◎ | ◎ | ◎ | 0.9 |
| Preparation Example 2 | 105 | 150 | ◎ | ◎ | ◎ | ◎ | 0.8 |
| Preparation Example 3 | 95 | 125 | ◎ | ◎ | ◎ | ◎ | 0.9 |
| Preparation Example 4 | 88 | 116 | ○ | ○ | ◎ | ◎ | 1.1 |
| Preparation Example 5 | 70 | 100 | ◎ | ○ | ◎ | ◎ | 1 |
| Preparation Example 6 | 60 | 85 | ◎ | ○ | ◎ | ◎ | 1.2 |
| Preparation Example 7 | 65 | 98 | ◎ | ○ | ◎ | ◎ | 1 |
| Preparation Example 8 | 123 | 165 | ◎ | ◎ | ◎ | ◎ | 1 |
| Preparation Example 9 | 130 | 180 | ◎ | ◎ | ◎ | ◎ | 0.8 |
| Preparation Example 10 | 120 | 171 | ◎ | ◎ | ○ | ◎ | 0.9 |
| Preparation Example 11 | 91 | 123 | ◎ | ◎ | ◎ | ◎ | 1.5 |
| Preparation Example 12 | 89 | 120 | ◎ | ◎ | ◎ | ◎ | 0.4 |
| Preparation Example 13 | 88 | 124 | ◎ | ◎ | ◎ | ◎ | 0.7 |
| Preparation Example 14 | 100 | 115 | ◎ | ◎ | ◎ | ◎ | 0.8 |
| Preparation Example 15 | 96 | 120 | ◎ | ◎ | ◎ | ◎ | 0.9 |
| Preparation Example 16 | 300 | | | | ※0 | | |
| Preparation Example 17 | 180 | | | | ※8 | | |
| Preparation Example 18 | 101 | 140 | X | ○ | X | ○ | 2.1 |
| Preparation Example 19 | | | | ※r | | | |
| Preparation Example 20 | | | | ※r | | | |
| Preparation Example 21 | 150 | 300 | ○ | X | ○ | ○ | 8 |
| Preparation Example 22 | 300 | 400 | ◎ | ○ | ◎ | ◎ | 2.5 |

※1: Evaluation was not performed due to blade inversion

※2: Evaluation was not performed due to failure in measuring initial electrical characteristics.

The prepared photoreceptors were measured and evaluated as follows. The results are shown in Tables 3 and 4.

TABLE 3

| | Initial characteristics | | |
|---|---|---|---|
| | Martens hardness (mN) | Elastic modulus (%) | Water contact angle (°) |
| Preparation Example 1 | 260 | 58 | 91 |
| Preparation Example 2 | 265 | 56 | 94 |
| Preparation Example 3 | 261 | 58 | 96 |
| Preparation Example 4 | 260 | 53 | 85 |
| Preparation Example 5 | 261 | 58 | 90 |
| Preparation Example 6 | 258 | 56 | 80 |
| Preparation Example 7 | 259 | 54 | 86 |
| Preparation Example 8 | 261 | 57 | 90 |
| Preparation Example 9 | 265 | 55 | 88 |
| Preparation Example 10 | 256 | 54 | 86 |
| Preparation Example 11 | 210 | 52 | 86 |
| Preparation Example 12 | 275 | 61 | 90 |
| Preparation Example 13 | 271 | 59 | 89 |
| Preparation Example 14 | 261 | 58 | 90 |
| Preparation Example 15 | 260 | 58 | 90 |
| Preparation Example 16 | 265 | 56 | 58 |
| Preparation Example 17 | 261 | 53 | 59 |
| Preparation Example 18 | 240 | 51 | 88 |
| Preparation Example 19 | 256 | 55 | 89 |

<Initial Characteristics>

Martens hardness of each photoreceptor was measured by using a micro hardness tester [manufactured by Fisher Instrument Co., Ltd., Picodenter HM500]. In addition, elastic modulus was measured when pushing the photoreceptor with a weight of 1 mN by using the same hardness tester.

Furthermore, pure water contact angle was measured by using a dropwise contact angle meter (manufactured by Kyowa Interface Chemical Co., Ltd.). Initial characteristics thereof are shown in Table 3.

<Potential Measurement>

Initial potential VL of the prepared photoreceptor was measured using a measuring probe of a surface potential meter [manufactured by Trek Japan Co., Ltd., MODEL344] after the photoreceptor was exposed to light under conditions of 10° C. and 10% RH.

In addition, potential after exposure $VL_{end}$ was measured after evaluating cleaning performance, using the measuring probe in the same manner as in the initial potential VL.

<Blade Squeal>

After measuring the initial potential VL, the photoreceptor was mounted on an electrophotographic imaging apparatus [manufactured by Samsung Electronics Co., Ltd., CLX-8650ND]. Then, blade squeal was evaluated while an image in A4 size, with individual colors of YMCBk at a coverage rate of 5%, was printed on 600,000 sheets of alkaline paper under conditions of 30° C. and 80% RH. The results are shown in Table 4. Evaluation criteria are as follows.

◎ : No blade squeal until 600,000 sheets were printed

○ : Slight blade squeal when the photoreceptor is started and stopped (No problem in use)

× : Continuous blade squeal

<Image Blurring>

After blade squeal was evaluated, the printer was maintained overnight. In the next morning, image blurring and image shaking were evaluated by printing a halftone image, and text 5% charts. The results are shown in Table 4. Evaluation criteria are as follows.

◎ : No image blurring and shaking

○ : Slight image blurring and shaking (No problem in use)

× : Severe image blurring and shaking

<Cleaning Performance>

After evaluating image blurring, an image in A4 size at a coverage rate of 5% was printed on 300,000 sheets of paper under conditions of 10° C. and 10% RH. Then, a halftone (HT) image was formed to evaluate cleaning performance by visual observation based on the following evaluation criteria. The results are shown in Table 4.

◎ : No image defect caused by poor cleaning performance

○ : Trace of toner leaked from at least one of charging roller and charging cleaning roller × : Image defect caused by poor cleaning performance <Scratch Resistance>

After measuring $VL_{end}$, scratches of the surface of the photoreceptor were checked by visual observation. The results are shown in Table 4. Evaluation criteria are as follows.

◎ : No scratches

○ : 1 to 5 scratches (No problem in use)

× : 6 or more scratches

<Thickness Loss Rate>

An initial thickness of each photoreceptor and a thickness thereof after measuring $VL_{end}$ and checking scratches of the surface of the photoreceptor were measured by using an Eddy-current thickness measuring device [manufactured by Fisher Instrument Co., Ltd., Fisherscope MMS]. A value obtained by dividing a difference between the initial thickness and the thickness after measuring $VL_{end}$ by rotation number of the photoreceptor expressed as kilo unit is defined as thickness loss ratio. The results are shown in Table 4. The "k OPC cycle" of Table 4 is rotation number of the photoreceptor expressed as kilo unit. For example, 10 k OPC cycle indicates that the photoreceptor rotated 10,000 times. Thus, the thickness loss rate is a value obtained by dividing a thickness (nm) of a layer abraded by rotations of 10,000 times by 10.

The photoreceptors prepared according to Preparation Examples 1 to 15 had low potential changes and excellent electrical characteristics after printing 900,000 sheets of paper. In addition, they had excellent evaluation results on blade squeal tests during printing, image blurring tests after printing 600,000 sheets, cleaning performance tests after printing further 300,000 sheets, and scratch tests after printing 900,000 sheets in total. Furthermore, the photoreceptors had low thickness loss rates. As such, characteristics required for photoreceptors were satisfied for a long time. Based on these results, it was confirmed that cleaning performance was maintained even after long-term use due to low abrasion of the surface of the photoreceptors, and the photoreceptors had high scratch resistance, low filming, low image blurring, and high durability.

In Preparation Example 16, the cleaning blade was inverted while printing under conditions of 30° C. and 80% RH. This is because sufficient sliding ability cannot be obtained on the metal oxide, the surface of which was not treated, as it can be seen from the fact that water contact angle is less than that of Preparation Example 1. In addition, the initial potential VL was low because the metal oxide, which was not surface-treated by the phosphorous-containing compound, was not uniformly dispersed in the protective layer.

Also, preparation examples in which the cleaning blade was inverted during evaluation are marked with 「※1」.

In Preparation Example 17, the cleaning blade was inverted while printing under conditions of 30° C. and 80% RH. This is because sufficient sliding ability cannot be obtained by the phosphorous-containing compound not including the lubricative moiety as a side chain as it can be seen from the fact that water contact angle is less than that of Preparation Example 1.

In Preparation Example 18, initial sliding ability was sufficient since water contact angle increased by adding the bi-terminal type modified silicone to the protective layer as a sliding ability improving agent. However, the sliding ability was vanished while printing 600,000 sheets, and then, continuous blade squeal occurred. In addition, slight image blurring and shaking were observed. Furthermore, after printing further 300,000 sheets, poor cleaning performance and abrasion of the surface of the photoreceptor were observed. This is because the bi-terminal type modified silicone segregated on the surface and was worn out while printing, thereby losing effects thereof. On the contrary, in Preparation Example 1, the phosphorous-containing compound including the lubricative moiety was uniformly dispersed and fixed (cured) in the protective layer, and thus surface segregation does not occur, thereby maintaining effects of the lubricative moiety.

When alumina was used as the metal oxide according to Preparation Example 19 and when silica was used as the metal oxide according to Preparation Example 20, evaluation was not able to be performed due to insufficient sensitivity. Since it was not possible to measure the initial potential VL, it was considered that a resistance value of the metal oxide was related thereto. In addition, preparation examples in which measuring the initial potential VL was not possible are marked with 「※2」.

On the contrary, when metal oxides including tin oxide, zinc oxide, or titanium oxide were used (Preparation Example 1 and Preparation Examples 5 to 10), excellent electrical characteristics were obtained.

Based on the results of Preparation Examples 1, 4, and 21, when the molecular weight of the phosphorus-containing compound was greater than 100000, hardness of the surface of the photoreceptor decreased and the thickness loss rate increased when compared with the phosphorous-containing compound having a molecular weight of 100000 or less. It is considered that a large molecular structure of the phosphorous-containing compound may inhibit reaction of the photocurable resin. In addition, in Preparation Example 21, potential increased after printing 900,000 sheets in comparison with Preparation Examples 1 and 4. Thus, it may be confirmed that the molecular weight of the phosphorus-containing compound influences electrical characteristics. This is because non-reacted functional groups function as traps of charges. In addition, when compared with Preparation Examples 16 and 17, in which the cleaning blade was inverted and evaluation was not possible, and Preparation Examples 19 and 20, in which initial electrical characteristics were not measurable, the evaluation results suggest that the electrophotographic photoreceptor of Preparation Example 21 may be considered to be useful.

In Preparation Example 22 in which metal-free phthalocyanine was used as the pigment of the charge generating layer, the potential itself and the change in potential were increased, when compared with examples using at least one selected from a group consisting of oxotitanyl phthalocyanine and gallium phthalocyanine (Preparation Examples 1, 14 and 15). Based on the results, it is considered that the pigment of the charge generating layer influences sensitivity of the photoreceptor. In addition, the evaluation results suggest that the electrophotographic photoreceptor according to Preparation Example 22 may be useful.

In the electrophotographic photoreceptor according to the present disclosure, since the protective layer includes metal oxide particles surface-treated with the phosphorous-containing compound including the phosphorous-oxoacid moiety reacting with the metal oxide particles, the lubricative moiety, and the photo-reactive moiety as side chains; and the photocurable resin matrix, the photo-reactive moiety of the phosphorous-containing compound, which reacts with the metal oxide particles via the phosphorous-oxoacid moiety, may be cross-linked with the photocurable resin. Thus, the metal oxide particles surface-treated with the phosphorus-containing compound may be uniformly dispersed in the protective layer. As a result, the lubricative moiety of the phosphorus-containing compound may be uniformly dispersed in protective layer. Thus, although the protective layer slowly peels while using the electrophotographic photoreceptor, lubricity of the protective layer may be maintained, and thus cleaning performance of the photoreceptor may be maintained. Thus, according to the present disclosure, an electrophotographic photoreceptor having excellent cleaning performance and high durability maintained for a long time and an electrophotographic imaging apparatus employing the electrophotographic photoreceptor may be provided.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. An electrophotographic photoreceptor comprising:

a conductive support;

a photosensitive layer disposed on the conductive support; and a protective layer disposed on the photosensitive layer, wherein the protective layer comprises:

a photocurable resin matrix, and a plurality of metal oxide particles surface-treated with a phosphorus-containing compound, and the phosphorus-containing compound is a polymer comprising:

a phosphorus-oxoacid moiety, a photo-reactive moiety, and a lubricative moiety comprising at least one element selected from a group consisting of fluorine and silicon, at side chains.

2. The electrophotographic photoreceptor of claim 1, wherein the polymer comprises a graft polymer.

3. The electrophotographic photoreceptor of claim 1, wherein the phosphorus-oxoacid moiety has a structure represented by Formula 1 below:

Formula 1

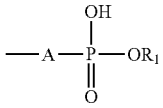

(1)

wherein $R_1$ comprises at least one selected from a group consisting of an alkyl group, an aryl group, and a hydrogen atom, and A comprises at least one selected from a group consisting of an oxygen atom and a methylene group.

4. The electrophotographic photoreceptor of claim 1, wherein the photo-reactive moiety has a structure represented by Formula 2 below:

Formula 2

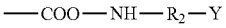

(2)

wherein $R_2$ is an alkylene group and Y is a photo-reactive functional group.

5. The electrophotographic photoreceptor of claim 4, wherein the photo-reactive functional group comprises at least one selected from a group consisting of an acryloyl group and a methacryloyl group.

6. The electrophotographic photoreceptor of claim 1, wherein the lubricative moiety has a structure represented by Formula 3 below:

Formula 3

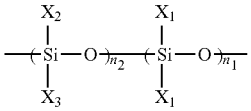

(3)

wherein $X_1$ is an alkyl group, $X_2$ comprises at least one selected from a group consisting of an alkyl group and an aryl group, $X_3$ comprises at least one selected from a group consisting of an alkyl group and an aryl group, $n_1$ is an integer from about 1 to about 500, and $n_2$ is an integer from about 1 to about 500.

7. The electrophotographic photoreceptor of claim 1, wherein the lubricative moiety comprises vinylfluoride (VF), vinylidene fluoride (VDF), tetrafluoroethylene (TFE), chlorotrifluoroethylene (CTFE), perfluoroalkoxy (PFA), fluorinated ethylene-propylene (FEP), ethylenetetrafluoroethylene (ETFE), ethylenechlorotrifluoroethylene (ECTFE), chlorotrifluoroethylenevinylidene fluoride (CTFEVF), tetrafluoroethylene-propylene (TFEP), perfluoropolyether (PFPE), perfluorosulfonic acid (PFSA), perfluoropolyoxetane (PFPO), or a combination thereof.

8. The electrophotographic photoreceptor of claim 1, wherein the lubricative moiety has a structure represented by Formula 4 below:

Formula 4

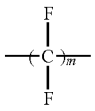

(4)

wherein m is an integer from about 1 to about 400.

9. The electrophotographic photoreceptor of claim 1, wherein the phosphorus-containing compound has a weight average molecular weight of about 300 to about 100,000.

10. The electrophotographic photoreceptor of claim 1, wherein the metal oxide particles have an aspect ratio of about 3 or greater.

11. An electrophotographic imaging apparatus comprising:

an electrophotographic photoreceptor comprising:

a conductive support, a photosensitive layer disposed on the conductive support, and a protective layer disposed on the photosensitive layer, wherein the protective layer comprises:

a photocurable resin matrix, and a plurality of metal oxide particles surface-treated with a phosphorus-containing compound, and the phosphorus-containing compound is a polymer comprising:

a phosphorus-oxoacid moiety, a photo-reactive moiety, and a lubricative moiety having at least one element selected from a group consisting of fluorine and silicon at side chains;

a charging unit configured to charge the electrophotographic photoreceptor;

an image exposure unit configured to form an electrostatic latent image on the electrophotographic photoreceptor by exposing the electrophotographic photoreceptor to light;

a developing unit configured to form a toner image by developing the electrostatic latent image formed on the electrophotographic photoreceptor using toner; and a cleaning unit configured to remove toner remaining on the electrophotographic photoreceptor after transferring the toner image to a transfer medium.

12. The electrophotographic imaging apparatus of claim 11, wherein the polymer comprises a graft polymer.

13. The electrophotographic imaging apparatus of claim 11, wherein the phosphorus-oxoacid moiety has a structure represented by Formula 1 below:

Formula 1

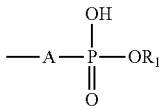

(1)

wherein $R_1$ comprises at least one selected from a group consisting of an alkyl group, an aryl group, and a hydrogen atom, and A comprises at least one selected from a group consisting of an oxygen atom and a methylene group.

14. The electrophotographic imaging apparatus of claim 11, wherein the photo-reactive moiety has a structure represented by Formula 2 below:

Formula 2

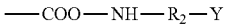

(2)

wherein $R_2$ is an alkylene group and Y is a photo-reactive functional group.

15. The electrophotographic imaging apparatus of claim 14, wherein the photo-reactive functional group comprises at least one selected from a group consisting of an acryloyl group and a methacryloyl group.

16. The electrophotographic imaging apparatus of claim 11, wherein the lubricative moiety has a structure represented by Formula 3 below:

Formula 3

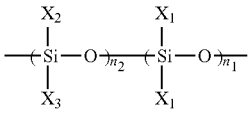

(3)

wherein $X_1$ is an alkyl group, $X_2$ comprises at least one selected from a group consisting of an alkyl group and an aryl group, $X_3$ comprises at least one selected from a group consisting of an alkyl group and an aryl group, $n_1$ is an integer from about 1 to about 500, and $n_2$ is an integer from about 1 to about 500.

17. The electrophotographic imaging apparatus of claim 11, wherein the lubricative moiety comprises vinylfluoride (VF), vinylidene fluoride (VDF), tetrafluoroethylene (TFE), chlorotrifluoroethylene (CTFE), perfluoroalkoxy (PFA), fluorinated ethylene-propylene (FEP), ethylenetetrafluoroethylene (ETFE), ethylenechlorotrifluoroethylene (ECTFE), chlorotrifluoroethylenevinylidene fluoride (CTFEVF), tetrafluoroethylene-propylene (TFEP), perfluoropolyether (PFPE), perfluorosulfonic acid (PFSA), perfluoropolyoxetane (PFPO), or a combination thereof.

18. The electrophotographic imaging apparatus of claim 11, wherein the lubricative moiety has a structure represented by Formula 4 below:

Formula 4

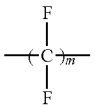

(4)

wherein m is an integer from about 1 to about 400.

19. The electrophotographic imaging apparatus of claim 11, wherein the phosphorus-containing compound has a weight average molecular weight of about 300 to about 100,000.

20. The electrophotographic imaging apparatus of claim 11, wherein the metal oxide particles have an aspect ratio of about 3 or greater.

* * * * *